US008998672B2

(12) United States Patent
Lin et al.

(10) Patent No.: US 8,998,672 B2
(45) Date of Patent: Apr. 7, 2015

(54) FACIAL EXPRESSION CONTROL DEVICE

(75) Inventors: Chyi-Yeu Lin, Taipei (TW); Chun-Chia Huang, Nantou County (TW)

(73) Assignee: National Taiwan University of Science and Technology, Taipei (TW)

( * ) Notice: Subject to any disclaimer, the term of this patent is extended or adjusted under 35 U.S.C. 154(b) by 317 days.

(21) Appl. No.: 13/439,874

(22) Filed: Apr. 5, 2012

(65) Prior Publication Data

US 2013/0139631 A1 Jun. 6, 2013

(30) Foreign Application Priority Data

Dec. 6, 2011 (TW) ..... 100144852 A

(51) Int. Cl.
*A63H 3/20* (2006.01)
*A63H 13/00* (2006.01)

(52) U.S. Cl.
CPC ..... *A63H 13/005* (2013.01); *Y10T 74/20012* (2015.01); *A63H 3/20* (2013.01)

(58) Field of Classification Search
USPC ..... 446/330, 268, 337–345; 74/25, 53–55
See application file for complete search history.

(56) References Cited

U.S. PATENT DOCUMENTS

| | | | | | |
|---|---|---|---|---|---|
| 961,262 | A | * | 6/1910 | Slough | 40/411 |
| 1,496,406 | A | * | 6/1924 | Bertsch | 446/341 |
| 1,547,183 | A | * | 7/1925 | Steele | 84/102 |
| 1,821,243 | A | * | 9/1931 | Springer | 446/341 |
| 2,175,311 | A | * | 10/1939 | Preston | 139/138 |
| 2,246,381 | A | * | 6/1941 | Paull | 40/463 |
| 2,285,472 | A | | 6/1942 | Tenenbaum | |
| 2,633,669 | A | * | 4/1953 | Churus | 446/353 |
| 2,641,866 | A | * | 6/1953 | Schiller | 446/342 |
| 2,720,053 | A | * | 10/1955 | Knott | 446/341 |
| 2,938,302 | A | * | 5/1960 | Walss | 446/341 |
| 2,954,639 | A | * | 10/1960 | Walss | 446/338 |
| 2,969,610 | A | * | 1/1961 | Weiner | 446/341 |
| 3,719,118 | A | * | 3/1973 | Colburn | 4/478 |
| 3,738,055 | A | * | 6/1973 | Marble | 446/341 |
| 3,757,465 | A | * | 9/1973 | Barlow | 446/341 |
| 4,272,918 | A | * | 6/1981 | Inoue | 446/300 |
| 4,537,300 | A | * | 8/1985 | Facchini | 198/453 |

(Continued)

FOREIGN PATENT DOCUMENTS

| | | |
|---|---|---|
| CN | 101940843 | 1/2011 |
| GB | 2134303 | 8/1984 |

(Continued)

OTHER PUBLICATIONS

"Search Report of China Counterpart Application", issued on Mar. 8, 2013, p. 1-p. 6.

(Continued)

*Primary Examiner* — Michael Dennis
*Assistant Examiner* — Urszula M Cegielnik
(74) *Attorney, Agent, or Firm* — Jianq Chyun IP Office

(57) ABSTRACT

A facial expression control device is provided. The facial expression control device of the present invention provides multiple structures and links, wherein the links are connected to the linking assembly; therefore varies facial expressions are expressed according to the combination of the structures and links. In this way, the facial expression is changed by means of the least actuators under the condition of maintaining the number of facial expression and imitation.

11 Claims, 14 Drawing Sheets

(56) References Cited

U.S. PATENT DOCUMENTS

| | | | | |
|---|---|---|---|---|
| 5,021,878 | A * | 6/1991 | Lang | 348/61 |
| 5,142,803 | A * | 9/1992 | Lang | 40/411 |
| 5,924,969 | A * | 7/1999 | Waluda | 493/374 |
| 6,068,536 | A * | 5/2000 | Madland et al. | 446/337 |
| 6,352,464 | B1 * | 3/2002 | Madland et al. | 446/337 |
| 6,652,349 | B1 * | 11/2003 | Wichter | 446/330 |
| 6,758,717 | B1 * | 7/2004 | Park et al. | 446/391 |
| 6,905,390 | B2 * | 6/2005 | Fukui et al. | 446/337 |
| 7,021,988 | B2 * | 4/2006 | Patton | 446/337 |
| 7,113,848 | B2 | 9/2006 | Hanson | |
| 7,234,988 | B2 * | 6/2007 | Patton | 446/337 |
| 7,738,997 | B2 | 6/2010 | Lin | |
| 7,904,204 | B2 | 3/2011 | Lin | |
| 8,596,152 | B2 * | 12/2013 | Piacenza et al. | 74/55 |
| 8,662,955 | B1 * | 3/2014 | Fai et al. | 446/337 |
| 2002/0019193 | A1 | 2/2002 | Maggiore et al. | |
| 2004/0249510 | A1 | 12/2004 | Hanson | |
| 2011/0179893 | A1 * | 7/2011 | Elliott et al. | 74/25 |

FOREIGN PATENT DOCUMENTS

| | | |
|---|---|---|
| JP | 1982-11279 | 1/1982 |
| JP | 2002-035440 | 2/2002 |
| JP | 3110260 U | 4/2005 |
| TW | 201010783 | 3/2010 |
| TW | M406453 | 7/2011 |

OTHER PUBLICATIONS

"http://hansonrobotics.wordpress.com/", retrieved on Apr. 2, 2012, Hanson Robotics.

"http://www.wowwee.com/en/support/elvis", retrieved on Apr. 2, 2012, Wow Wee Astonishing Imagination: Elvis.

"Office Action of Taiwan Counterpart Application" , issued on Jan. 20, 2014, p. 1-p. 4.

Hiroshi Kobayashi, et al., "Study on face robot for active human interface-mechanisms of face robot and expression of 6 basic facial expressions", Proceedings of IEEE International Workshop on Robot and Human Communication, Nov. 3-5, 1993, pp. 276-281.

H. Kobayashi, et al., "Study on Face Robot Platform as a KANSEI Medium", IEEE International Conference on Industrial Electronics, Control and Instrumentation, Oct. 2000, pp. 481-486.

Takashi Minato, et al., "Development of an android robot for studying human-robot interaction", Proc. 17th International Conference on Industrial and Engineering Applications of Artificial Intelligence and Expert Systems, Ottawa, Canada, 2004, pp. 424-434.

Jun-Ho Oh, et al., "Design of Android type Humanoid Robot Albert HUBO", Intelligent Robots and Systems, IEEE/RSJ International Conference, Oct. 9-15, 2006, pp. 1428-1433.

Dong-Wook Lee, et al., "Development of an Android for Emotional Expression and Human Interaction", Proceedings of International Federation of Automatic Control, Jul. 6-11, 2008, pp. 4336-4337.

Shin'Ichiro Nakaoka, et al., "Creating facial motions of Cybernetic Human HRP-4C", 9th IEEE-RAS International Conference on Humanoid Robots, Dec. 7-11, 2009, pp. 561-567.

Chyi-Yeu Lin, et al., "The realization of robot theater:humanoid robots and theatric performance", International Conference on Advanced Robotics (ICAR), Jun. 22-26, 2009, pp. 1-6.

D. Hanson, et al. "Identity Emulation (IE): Bio-inspired Facial Expression Interfaces for Emotive Robots", Proc. AAAI National Conference in Edmonton, 2002, pp. 1-11.

Takuya Hashimoto, et al., "Development of the Face Robot SAYA for Rich Facial Expressions", SICE-ICASE International Joint Conference 2006, Oct. 18-21, 2006, pp. 5423-5428, Bexco, Busan, Korea.

Hiroshi Ishiguro, "Android Science: Toward a new cross-interdisciplinary framework", The 12th International Symposium of Robotics Research, 2005, pp. 1-6.

Minoru Hashimoto, et al., "Development and Control of a Face Robot Imitating Human Muscular Structures", Proceedings of the 2006 IEEE/RSJ International Conference on Intelligent Robots and Systems, Oct. 9-15, 2006, pp. 1855-1860.

Karsten Berns, et al., "The Mechatonic Design of a Human-like Robot Head", 16th CISM-IFToMM Symposium on Robot Design, Dynamics, and Control (ROMANSY), 2006, pp. 1-8.

"Office Action of China Counterpart Application", issued on May 20, 2014, p. 1-p. 7.

* cited by examiner

FACIAL EXPRESSION CONTROL DEVICE

CROSS-REFERENCE TO RELATED APPLICATION

This application claims the priority benefit of Taiwan application serial no. 100144852, filed on Dec. 6, 2011. The entirety of the above-mentioned patent application is hereby incorporated by reference herein and made a part of this specification.

BACKGROUND OF THE INVENTION

1. Field of the Invention

The present invention is related to a control device and a robot using the control device, and more particularly, is related to a facial expression control device and a robot head using the facial expression control device.

2. Description of Related Art

The technique of emulation robot head having a humanoid appearance is proposed by Hara and Kobayashi of Tokyo Institute of Technology. They used pneumatic actuators to control the artificial facial skin fabricated by the silicone rubber. The artificial facial skin is provided with softness and flexibility, and thus the facial skin can express six basic facial expressions (surprised, frightened, sad, angry, happy and disgust) by pulling 19 control points disposed behind the facial skin. Wherein the selection of the control points are based on the facial expression coding system proposed by Ekman and 14 expression control units sufficient to compose 6 basic facial expressions are selected and used. And according to the definition, the expressions of human face can be composed from 44 groups of expression control units, i.e., the number of the expression control units determines the number of variation of expressions. Accordingly, many researchers regard this as a basis, and then the techniques related the robot head are published one after another, including the techniques of controlling facial skin variation by the methods of using memory alloy, motor, electroactive polymers (EVA) and the like, wherein the method of using motors to control facial skin for expression variation is the most commonly used. The main reason of using motors to control facial expressions is that motor has a faster response rate and uses electric power as the power source, and other assistant devices are not necessary (e.g., pneumatic compressors).

The well known companies who develop the related products of the emulation robot head include Kokoro of Japan, Hanson Robotic and Wow Wee of US and Xi An Superman of China. The robot heads of each of the above mentioned companies have different degree of freedom (DOF) (the expression variation) according to their different purpose. However, the expression variation mainly depends upon how many actuators have been used. In addition, the patents related to robot head include U.S. Pat. No. 7,113,848 and Japan Patent Publication No. 200235440. U.S. Pat. No. 7,113,848 discloses a humanoid face capable of facial expression including a plurality of actuators disposed in a casing, a linkage connected to the actuators and an outer skin connected to the linkage. Japan Patent Publication No. 200235440 discloses a humanoid face capable of facial expression including multiple flexible latching rings disposed at particular locations in an inner side of the skin, and the latching rings connected to the skin by a special connecting adhesive.

Review the currently known patents, references and products, it can be seen that, regardless of the way to achieve the facial expression, the robot head capable of facial expression generally has to use a large number of motors (e.g., 10 to 20 motors), pneumatic actuator, electric power driving memory alloy and the like to vary the controlling points of the facial skin to achieve different facial expressions. Each of the large number of actuators (motors, pneumatic actuators, electric power driving memory alloy) used in the conventional robot head operates in a way of capable to vary the position of one control point (a single degree of freedom). Thus in order that the robot head has a sufficient facial expressions (joyous, angry, sad, happy and the like), at least 12 motors is necessary to respectively drive different control point, resulting in manufacturing cost of the robot head remaining high and increase of difficulty of mechanism design and repair. The most important thing is the reliability of products may be decreased. And those reasons may be the main obstacle for the robot head capable of facial expressions to become a widespread product.

SUMMARY OF THE INVENTION

According to the currently known patents, references and products, it can be seen that, the robot head capable of facial expression generally has to use a large number of actuators to drive the controlling points of the facial skin to show variety facial expressions. And the more actuators are used, the more facial expressions the robot head has, which results in high manufacturing cost of the robot head and complex fabricating processes. Accordingly, the invention provides a simplified device which has various facial expressions with less actuator used.

The present invention provides a facial expression control device including a frame, a rotating element, a plurality of pushing bars, an actuator and a linking assembly. The actuator drives the rotating element to rotate, so that the pushing bars with the same length correspondingly prop against the facial expression control structures of the rotating element via the relative movement between the rotating element and the pushing bars, wherein each of the facial expression control structures may be indentations or protrusions relative to the surface of the rotating element and thereby each of the facial expression control structures has a shifting distance relative to the surface, and thus when the pushing bars prop against the facial expression control structures, the lengths protruded from the surface of the rotating element vary, and the control bars of the linking assembly are further driven to rotate. Accordingly, the control points of the facial skin linked with the control bars are driven to make the facial skin show the expression variations.

In light of the above, the facial expression control device in the present invention has rows of facial expression control structures with different height or depth disposed on the rotating element of the expression selecting assembly to provide a plurality of shifting distances, and by means of the cooperation of the facial expression control structures and the pushing bars with pushing or pulling the facial expression control device, the robot head using the facial expression control device can represent various facial expressions with less number of actuators.

In order to make the aforementioned features and advantages of the disclosure more comprehensible, embodiments with reference to accompanying drawings are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

According to the related art, based on the current technology, if the robot is required to have sufficient facial expressions, a plurality of control points are necessary to be disposed on the facial skin, and thus the required quantity of the actuators which respectively drive the control points cannot effectively be reduced. Limited by the current technology, the manufacturing cost cannot effectively reduced, and it may lead to the robot capable of various facial expressions cannot be extensively used. On the other hand, if the quantity of the actuators is reduced, the robot may have less expression variation and the robot may look inflexible.

Accordingly, the present invention provides a facial expression control device. A plurality of rows of facial expression control structures with different heights or depths are disposed on the rotating element of the facial expression control device to provide shifting distances. And with the cooperation of the pushing bars, the facial expression control device can show various expressions by using only one rotating element to drive the plurality of control points of the facial skin. In other words, a plurality of control points are controlled by comparatively less actuators in the present invention, so that the robot head has a plenty of facial expression variation with good emulation. The following describes the configuration of the facial expression control device of the present invention and applications.

First Embodiment

Figure 1:
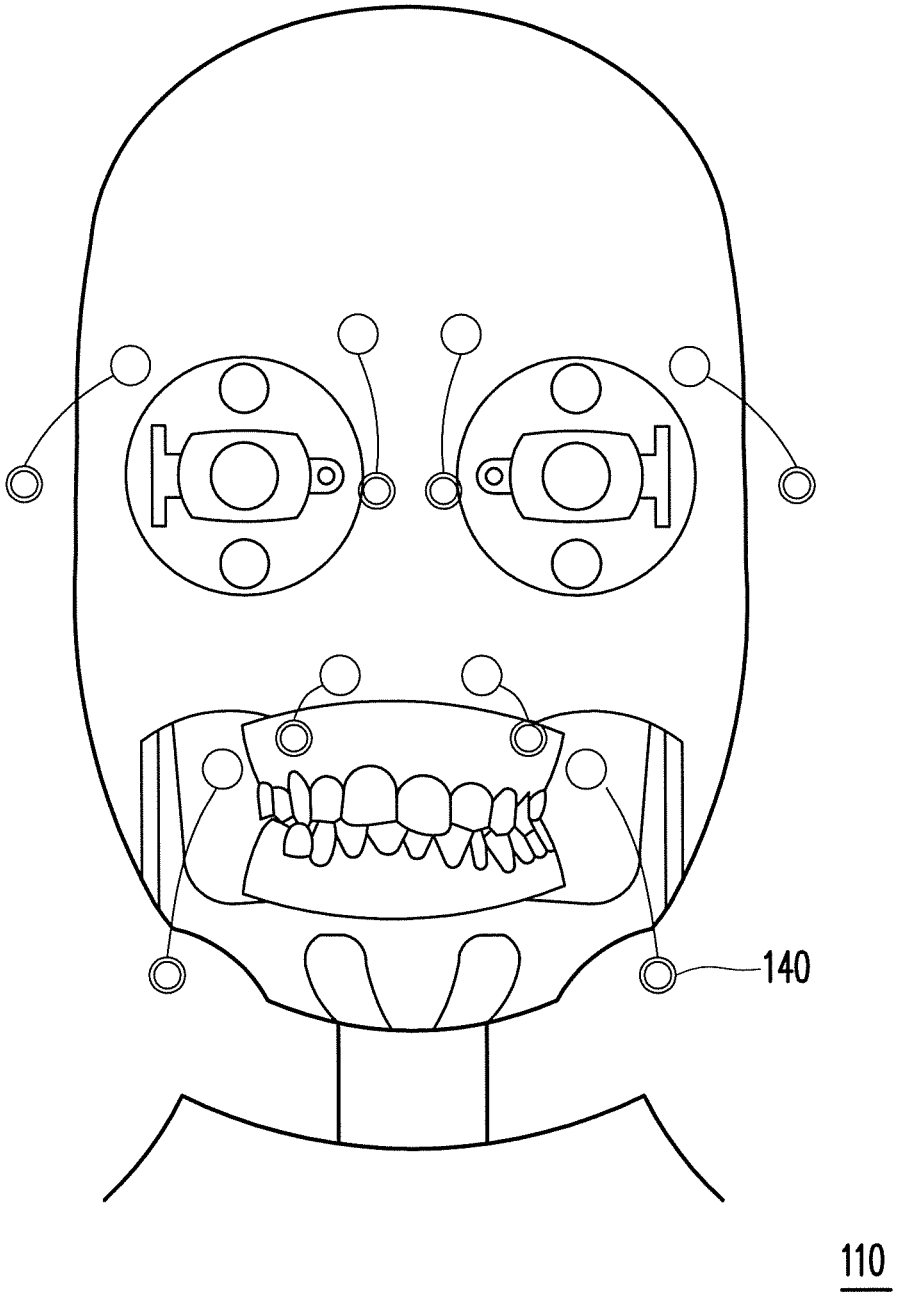
FIG. 1 is a schematic view of a facial skin of a robot head taken from the head of the robot.
Figure 2:
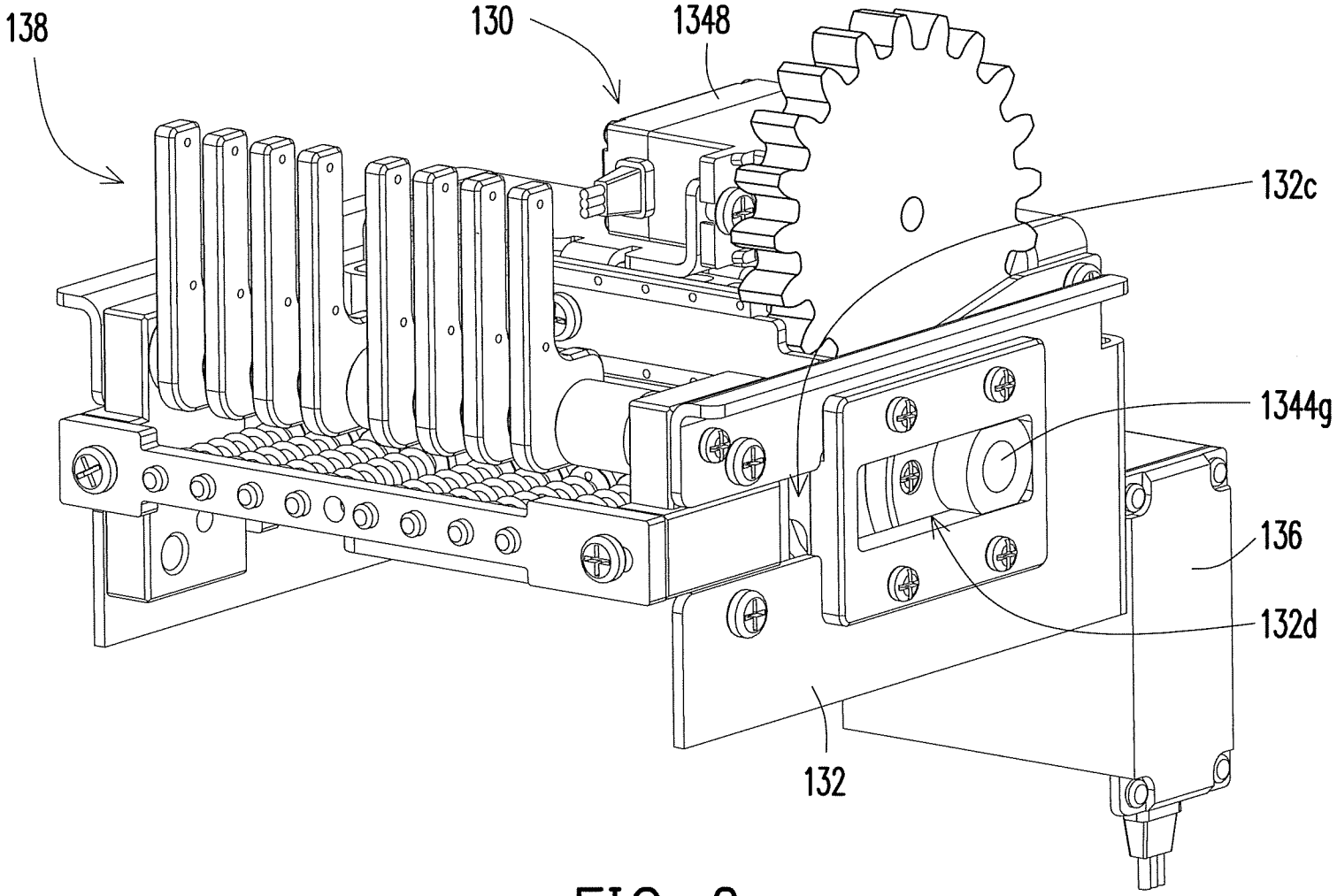
FIG. 2 is a schematic view of a facial expression control device disposed in the head.

FIG. 1 is a schematic view of a facial skin of a robot head taken from the head of the robot. FIG. 2 is a schematic view of a facial expression control device disposed in the head. Referring to FIG. 1 and FIG. 2 together, the robot head includes a head 110, a facial skin (not shown), a facial expression control device 130, a main base 132 and a pushing assembly 136, wherein the head 110 has a cavity (not shown) used for placing the facial expression control device 130. The main base 132 is disposed in the cavity and the facial skin covers the head 110. The facial expression control device 130 is assembled to the main base 132 and connected with the facial skin. And the pushing assembly 136 is located relatively behind the head 110. The pushing assembly 136 pushes the facial expression control device 130 so as to pull the control points of the facial skin to make the robot head show facial expressions.

Figure 3:
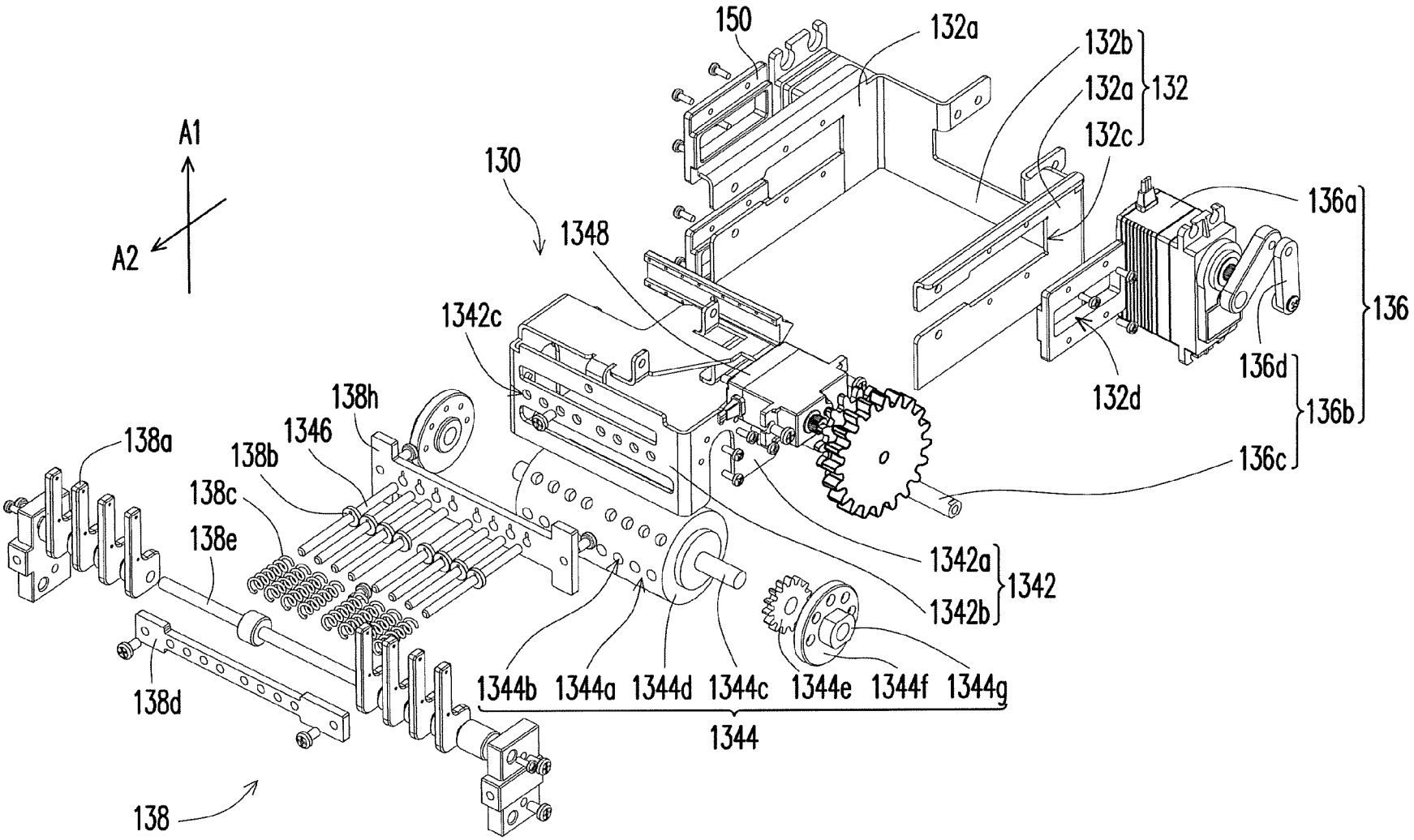
FIG. 3 is an exploded view of the facial expression control device of FIG. 2.

FIG. 3 is an exploded view of the facial expression control device of FIG. 2. Referring to FIG. 2 and FIG. 3 together, the main base 132 of the embodiment includes a pair of first sidewalls 132*a* and a second sidewall 132*b*. The first sidewalls 132*a* are substantially parallel to each other. The second sidewalls 132*b* are connected between the first sidewalls 132*a*. The facial expression control device 130 is assembled on the main base 132, and the pushing assembly 136 is assembled on the second sidewall 132*b*. In addition, each of the first sidewalls 132*a* has an assembling slot 132*c* thereon, and the locations of the two assembling slots 132*c* correspond to each other so that the facial expression control device 130 is movably assembled in the assembling slots 132*c*.

The facial expression control device 130 includes a frame 1342, a rotating element 1344, a plurality of pushing bars 1346 and an actuator 1348. The frame 1342 includes a pair of third sidewalls 1342*a* and a fourth sidewall 1342*b*, wherein the two third sidewalls 1342*a* are substantially parallel to each other, and the fourth sidewall 1342*b* is opposite to the second sidewall 132*b* and connected between the two third sidewalls 1342*a*, and the fourth sidewall 1342*b* has a plurality of holes 1342*c*. The rotating element 1344 is pivoted to third sidewalls 1342*a* of the frame 1342 and located in the space surrounded by the third sidewalls 1342*a*, the fourth sidewall 1342*b* and the second sidewall 132*b*. The facial expression control device 130 is pushed by the pushing assembly 136 and moves relative to the main base 132.

Figure 4A:
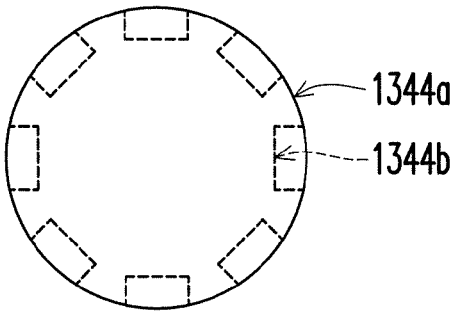
FIG. 4A to FIG. 4C are schematic views of other embodiments of the facial expression control structures.
Figure 4B:
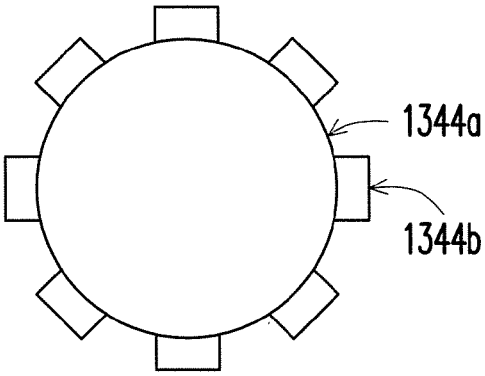
Figure 4C:
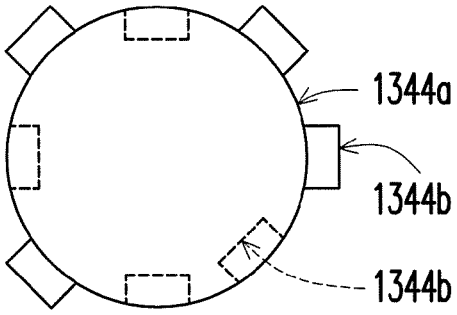

The rotating element 1344 has at least one surface 1344*a* and a plurality of rows of facial expression control structures 1344*b* arranged in rows on the surface 1344*a*, and each of the facial expression control structures 1344*b* has a shifting distance relative to the surface 1344*a*. More specifically, the rotating element 1344 includes a rotating shaft 1344*c*, a sleeve 1344*d*, a transmission element 1344*e* and a pair of sliding elements 1344*f*, wherein the sleeve 1344*d* is disposed around and fixed to the rotating shaft 1344*c*, and the sleeve 1344*d* can be a cylinder or a polyhedral prism as required. In the present embodiment, the sleeve 1344*d* is a cylinder, and the surface 1344*a* and the facial expression control structures 1344*b* are disposed on the sleeve 1344*d*. In other embodiments not shown in figures, the sleeve 1344*d* can be a polyhedral prism and thus the rotating element 1344 may have a plurality of surfaces connected to one after another, and multiple rows of the facial expression structures 1344*b* can be disposed on each surface according to the requirements. Moreover, the facial expression control structures 1344*b* of FIG. 2 and FIG. 3 are indentations (shown in FIG. 4A) facing the rotating shaft 1344*c* and concaving on the surface 1344*a*, for example. And people who have ordinary skill in the art can design the facial expression control structures 1344*b* according to the actual demand with the protrusions (shown in FIG. 4B) protruding from the surface 1344*a* toward the direction relatively away from the rotating shaft 1344*c*, or with the combination of the indentations and the protrusions (shown in FIG. 4C). All of the above mentioned methods can achieve the functions and purpose of the facial expression structures 1344*b*.

As described above, the transmission element 1344*e* is disposed around the rotating shaft 1344*c* located beside the sleeve 1344*d*, wherein the transmission element 1344*e* contacts with the actuator 1348 fixed on the frame 1342, so that when the actuator 1348 is driven, the transmission element 1344*e* is rotated by the actuator 1348 and thereby drives the rotating shaft 1344*c* and the sleeve 1344*d* to rotate. The second ring 1344*f* is disposed around the rotating shaft 1344*c* and located at the two sides of the sleeve 1344*d*. The main base 132 further has a pair of sliding slots 132*d* overlapped with a portion of the assembling slot 132*c*. Each of the sliding elements 1344*f* has a protruding portion 1344*g*, and the protruding portions 1344*g* are respectively located in the sliding slots 132*d*. The sliding slot 132*d* can be formed on the assembling plate 150, wherein the location of the assembling plate 150 corresponds to the location of the assembling slot 132*c*, and the sliding slot 132*d* is assembled on the first sidewall 132*a* of the main base 132.

In addition, the pushing bars 1346 are arranged in a row and respectively passing through the holes 1342*c* of the fourth sidewall 1342*b* of the frame 1342, and further respectively prop against to one row of the facial expression control structures 1344*b* disposed on the surface 1344*a* of the rotating element 1344. Additionally, the quantity of the facial expression control structures 1344*b* of each row is different or not, wherein the quantity of the facial expression control structures 1344*b* is the same in every row in this embodiment. The number of the pushing bars 1346 can be less than or equal to the number of the facial expression control structures 1344*b* of each row according to actual requirements. In other words, the sleeve 1344*d* of the rotating element 1344 is modulized in fabrication, and thus the quantity of facial expression control structures 1344*b* of each row is predetermined. In order to meet the demand of number of expressions of every robot head, the quantity of pushing bars 1346 can be changed. For example, if a robot head having facial expressions with variety and diversification is needed, the largest number of pushing bars 1346 is equal to the number of facial expression structures 1344*b* of each row; and if the robot head having facial expressions is required to have comparatively less expressions, the control points which drives the facial skin (not shown) can be reduced and thus the number of pushing bars 1346 can be less than that of the facial expression control structures 1344*b* of each row.

In addition, regardless of the facial expression control structures 1344*b* being the indentations concaving to the surface 1344*a* or the protrusions protruding from the surface 1344*a*, the distances of ends of any two adjacent facial expression control structures 1344*b* relative to the surface 1344*a* may vary, so that the facial skin (not shown) can show much more facial expressions. In more detailed, any two adjacent facial expression control structures 1344*b* can both be the protrusions (or indentations), and the distances of the ends of any two adjacent protrusions (or indentations) relative to the surface 1344*a* are the same or different. Moreover, any two of the adjacent facial expression control structures 1344*b* can be a protrusion and a indentation, and the distance between the top terminal of the protrusion and the surface 1344*a* and that between the indentation and the surface 1344*a* can also be the same or different.

Figure 5:
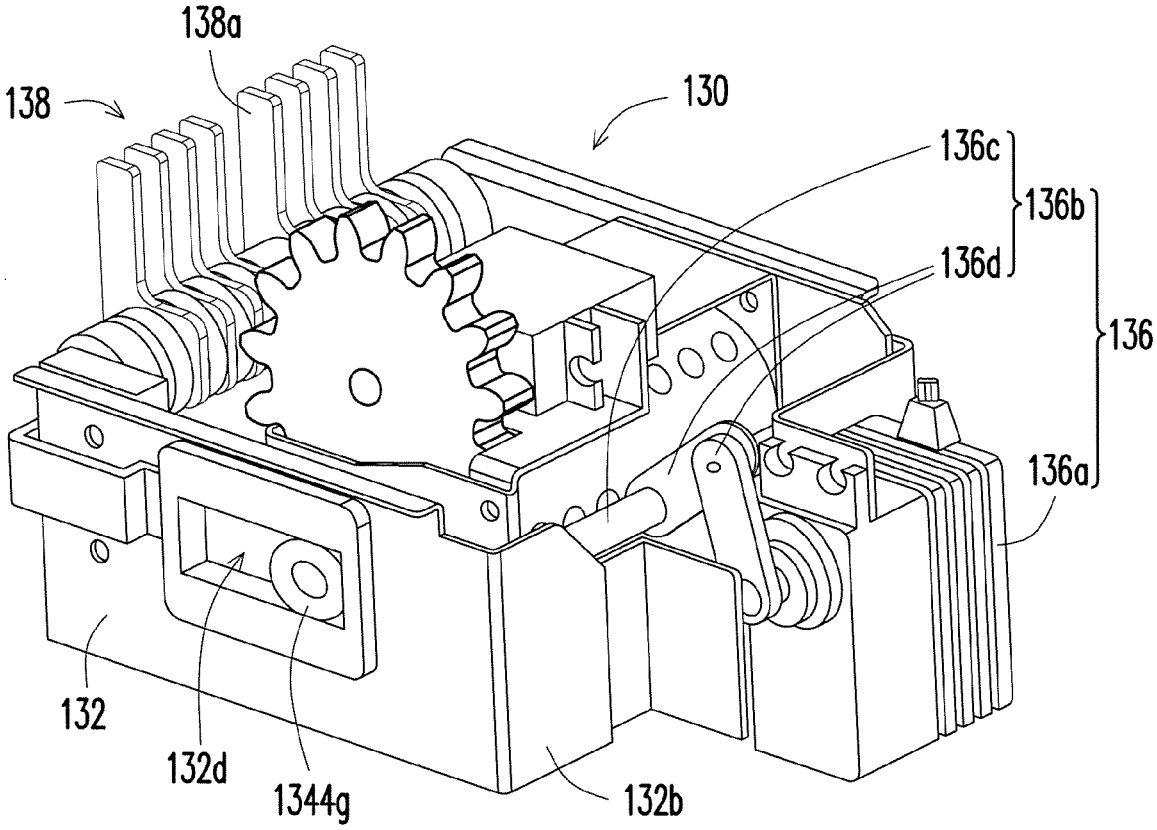
FIG. 5 is a schematic view of the facial expression control device of FIG. 2 from another viewing angle.

FIG. 5 is a schematic view of the facial expression control device of FIG. 2 from another viewing angle. Referring to FIG. 2, FIG. 3 and FIG. 5, the pushing assembly 136 is disposed on the second sidewall 132*b* of the main base 132 and located relatively behind the head 110 (shown in FIG. 1). And the pushing assembly 136 is connected with the facial expression control device 130. And through the cooperation of the facial expression control device 130 and the sliding slots 132*d*, the pushing assembly 136 can push the facial expression control device 130 to move relative to the main base 132. More specifically, the pushing assembly 136 includes an actuator 136*a* and a linking assembly 136*b*, wherein the actuator 136*a* is a motor and disposed on the second sidewall 132*b*. The linking assembly 136*b* includes a first linkage 136*c* and a second linkage 136*d*. The first linkage 136*c* is pivoted between the third sidewalls 1342*a* of the facial expression control device 130. An end of the second linkage 136*d* is connected to the actuator 136*a* and the other end of the second linkage 136*d* is connected to the first linkage 136*c*. And when the actuator 136*a* is actuated, the second linkage 136*d* pushes or pulls the first linkage 136*c*, so that the facial expression control device 130 can move relative to the main base through the cooperation of the protruding portion 1344*g* and the sliding slot 132*d*. Herein the second linkage 136*d* of the present embodiment is composed of two connecting rods. In other embodiments not shown in figures, the second linkage 136*d* can be a single rod.

Referring to FIG. 2 and FIG. 3, the linking assembly 138 is disposed on the main case 132 and located relatively ahead the head 110 (shown in FIG. 1). The facial expression control device 130 is located between the pushing assembly 136 and the linking assembly 138, wherein the linking assembly 138 includes a plurality of control bars 138*a*. The axial direction A1 of the control bar 138*a* and the axial direction A2 of the pushing bar 1346 are perpendicular to each other. And the control bars 138*a* drive the linking movement between the pushing bars 1346 and the facial skin (not shown), and thus the movements of the control bars 138*a* drive the facial skin (not shown) to show expressions. In this embodiment, latching rings 140 (shown in FIG. 1) connected to the control bars 138*a* are disposed in the facial skin (not shown) to influence the facial skin.

Figure 6:
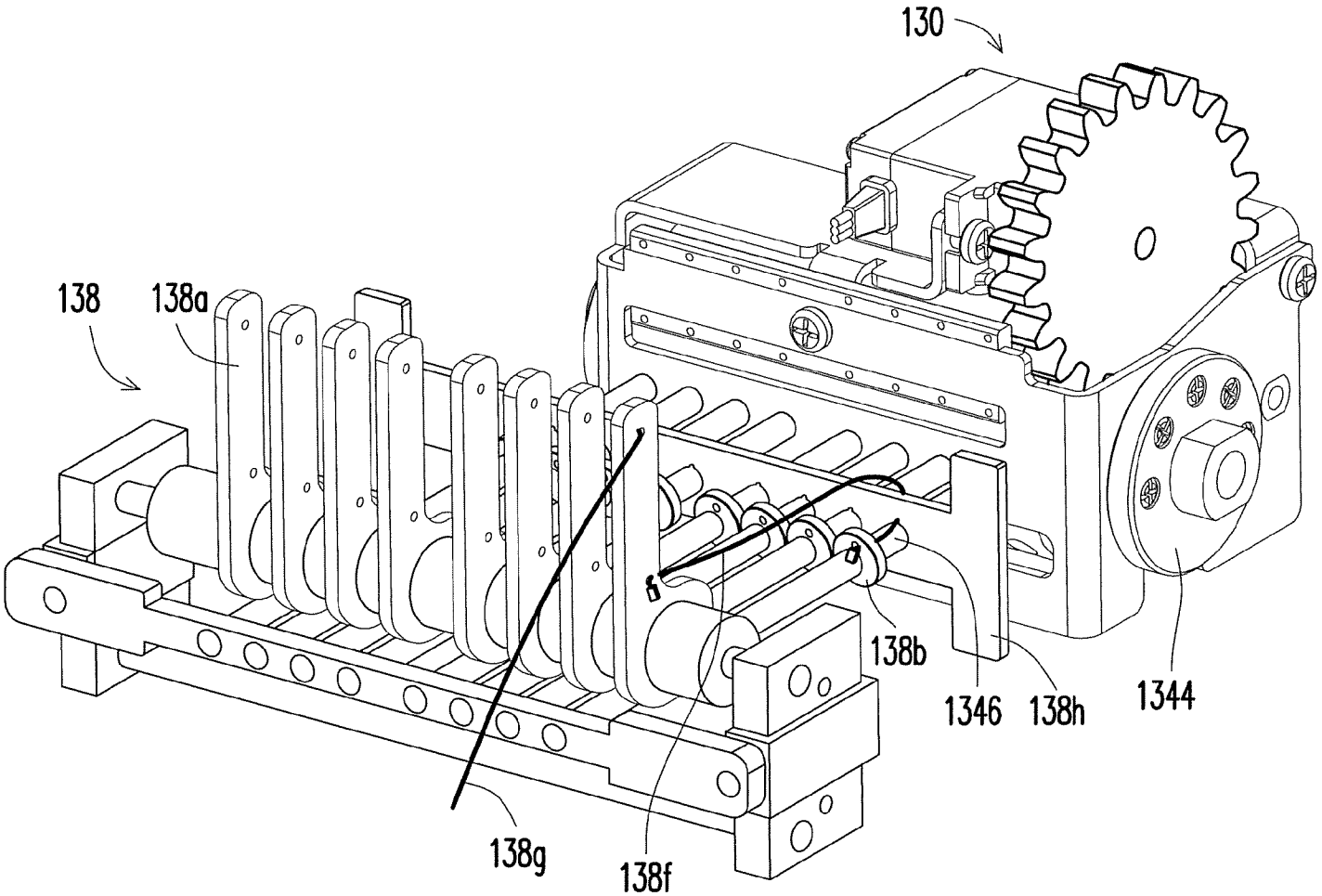
FIG. 6 is a schematic view illustrating the linking assembly and the facial expression control device are assembled together.

FIG. 6 is a schematic view illustrating the linking assembly and the facial expression control device are assembled together. Referring to FIG. 3 and FIG. 6 together, specifically, the linking assembly 138 includes the plurality of control bars 138*a* mentioned above, a plurality of limiting rings 138*b*, a plurality of springs 138*c*, a first assembling plate 138*d*, a rotating shaft 138*e*, a plurality of first wires 138*f*, a plurality of second wires 138*g* and a second assembling plate 138*h*. The limiting rings 138*b* are respectively disposed around the pushing bars 1346 to restrict the depth of the pushing bars 1346 relative to the fourth sidewall 1342*b*. The springs 138*c* are respectively disposed around the end of pushing bars 1346 relatively away from the rotating element 1344 and prop against between the first assembling plate 138*d* of the frame 1342 and the limiting rings 138*b*. The rotating shaft 138*e* is pivoted between the two third sidewalls 1342*a* of the frame 1342. The rotating shafts 138*e* penetrates through the control bars 138*a* and such that the control bars 138*a* are pivoted upon the rotating shaft 138*e* as the control bars 138*a* driven by the pushing bars 1346. The second assembling plate 138*h* is located between the frame 1342 and the first assembling plate 138*d*, and the pushing bars 1346 are passing through the second assembling plate 138*h*. An end of each first wire 138*f* is respectively fixed to one of the control bar 138*a*, and passing through the second assembling plate 138*h*, and the other end of each first wire 138*f* is fixed to the limiting ring 138*b*. In this way, the first wires 138*f* pull the corresponding control bars 138*a* to rotate according to the length formed by the pushing bar 1346 protruding from the surface 1344*a* of the rotating element 1344. An end of each second wire 138*g* is respectively fixed to one of the control bars 138*a*, and a latching ring 140 (shown in FIG. 1) is disposed on the other end of each second wire 138*g*. And the latching rings 140 further latch to the latching ring (not shown) disposed within the facial skin (not shown), and thus the second wire 138*g* can pull the control point of the facial skin (not shown) according to the rotating angle of the control bar 138*a*.

The following describes in detail how the facial expression control device 130 drives the facial skin (not shown) to show expressions.

Referring to FIG. 3, FIG. 5 and FIG. 6, when the pushing assembly 136 is not driven, the first linkage 136*c* is located relatively near the second sidewall 132*b* of the main base 132, and a distance is between an end of the pushing bars 1346 of the facial expression control device 130 relatively away from the linking assembly 138 and the rotating element 1344. In the meanwhile, the control bars 138*a* of the linking assembly 138 are not driven, and thus the axial direction A1 of each control bar 138*a* is perpendicular to the axial direction A2 of the pushing bars 1346. Additionally, there may no facial expression control structure 1344*b* disposed on a portion of the surface 1344*a* of the rotating element 1344, and the pushing bars 1346 prop against the location where no facial expression control structure 1344*b* is disposed thereon of the surface 1344*a*. Furthermore, when the robot head has no expression, the axial direction A1 of the control bars 138*a* and the axial direction A2 of the pushing bars 1346 being perpendicular to each other is only one of the possible embodiments. In other embodiments, the axial directions A1 of the control bars 138*a* and the axial direction A2 of the pushing bars 1346 may not be perpendicular to each other.

Figure 7:
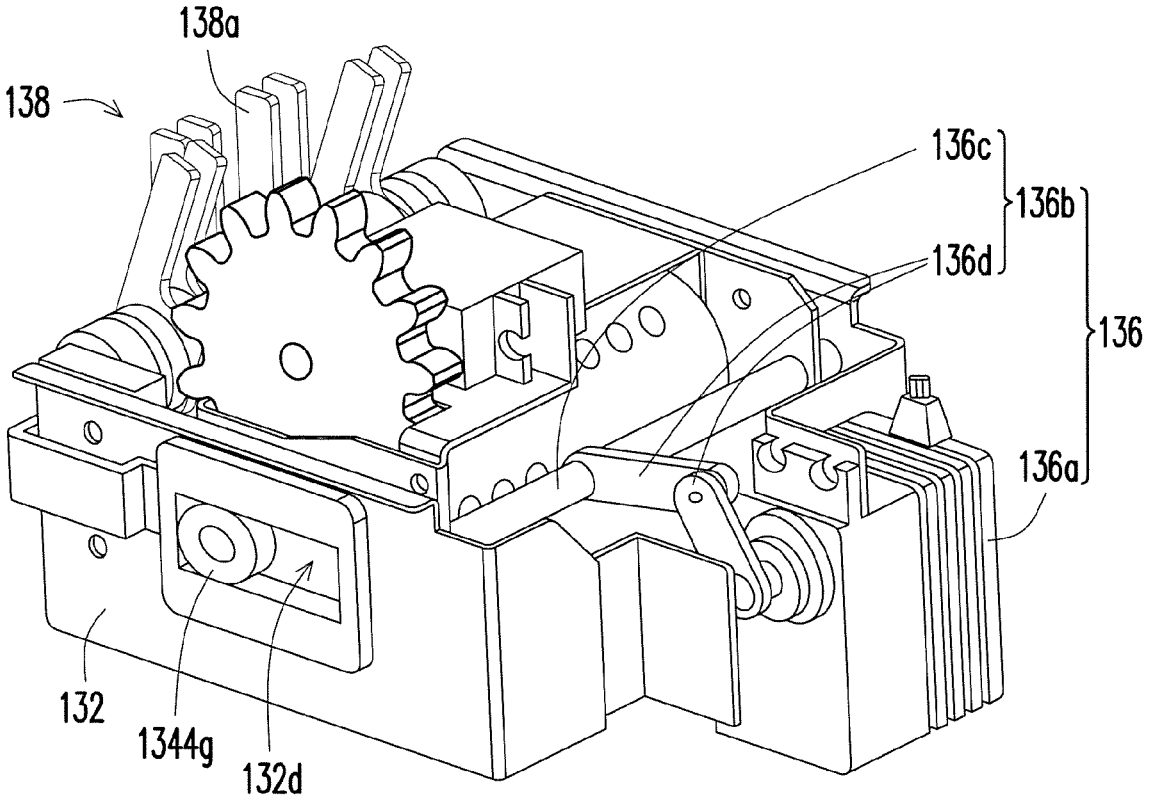
FIG. 7 is a schematic view illustrating the pushing assembly pushing the facial expression control device.
Figure 8:
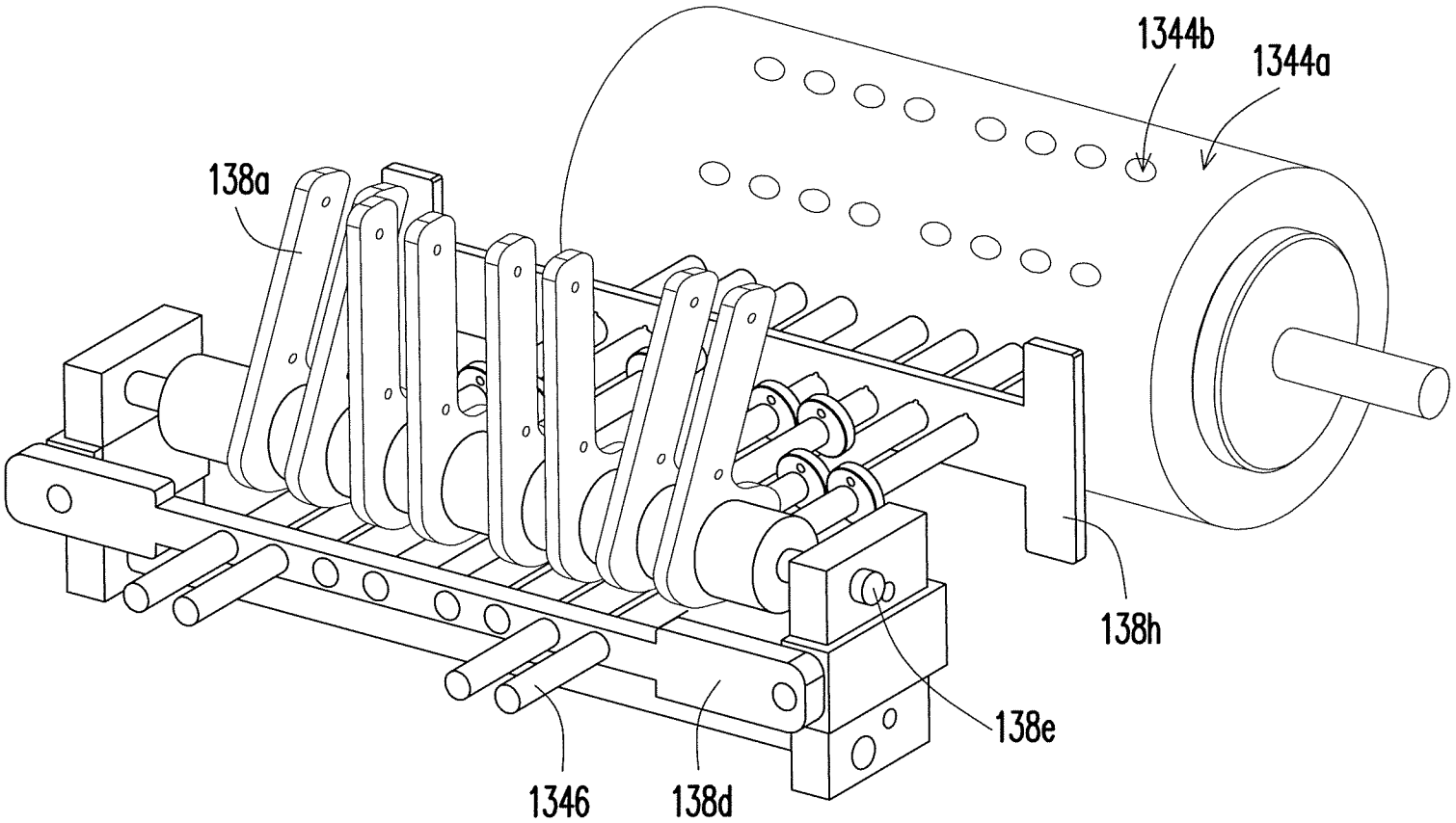
FIG. 8 is a schematic view of the rotating element and the linking assembly of FIG. 7.

FIG. 7 is a schematic view illustrating the pushing assembly pushing the facial expression control device. FIG. 8 is a schematic view of the rotating element and the linking assembly of FIG. 7. FIG. 7 and FIG. 8 are in different viewing angles. Referring to FIG. 3, FIG. 6, FIG. 7 and FIG. 8, when the facial expression control device 130 is driven, the rotating element 1344 is driven to rotate by the actuator 1348 driving the transmission element 1344*e*. Then, one of the rows of facial expression control structures 1344*b* is aligned correspondingly to the pushing bars 1346. In the meanwhile, the actuator 136*a* of the pushing assembly 136 is driven, the first linkage 136*c* drives the second linkage 136*d* to push the facial expression control device 130 to move forward, the protruding portions 1344*g* of the sliding elements 1344*f* respectively slides in the assembling slots 132*c*, and the pushing bars 1346 prop against the facial expression control structures 1344*b* of the rotating element 1344 respectively. Since the distances of the ends of the facial expression control structures 1344*b* relative to the surface 1344*a* vary, the lengths of the pushing bars 1346 protruded from the surface 1344*a* of the rotating element 1344 also vary. And in the meanwhile, the first wires 138*f* are pulled by the pushing bars 1346 and drive the control bars 138*a* to rotate by taking the rotating shaft 138*e* as a rotating center. Herein the rotating angle of the control bars 138*a* is related to the shifting distances that the ends of the facial expression control structures 1344*b* relative to the surface 1344*a*, and the second wires 138*g* are affected by the rotation of the control bars 138*a*, and the latching rings 140 located at the ends of the second wires 138*g* further drive the corresponding control point disposed on the facial skin (not shown), and the facial skin (not shown) is pulled to show expressions.

When the pushing assembly 136 pulls back the facial expression control device 130 to return to the original position, the springs 138*c*, which are compressed by a distance changing between the limiting rings 138*b* and the first assembling plates 138*d* due to the movement of the pushing bars 1346, may drive the limiting rings 138*b* back to the original position due to its own resilience.

Figure 9:
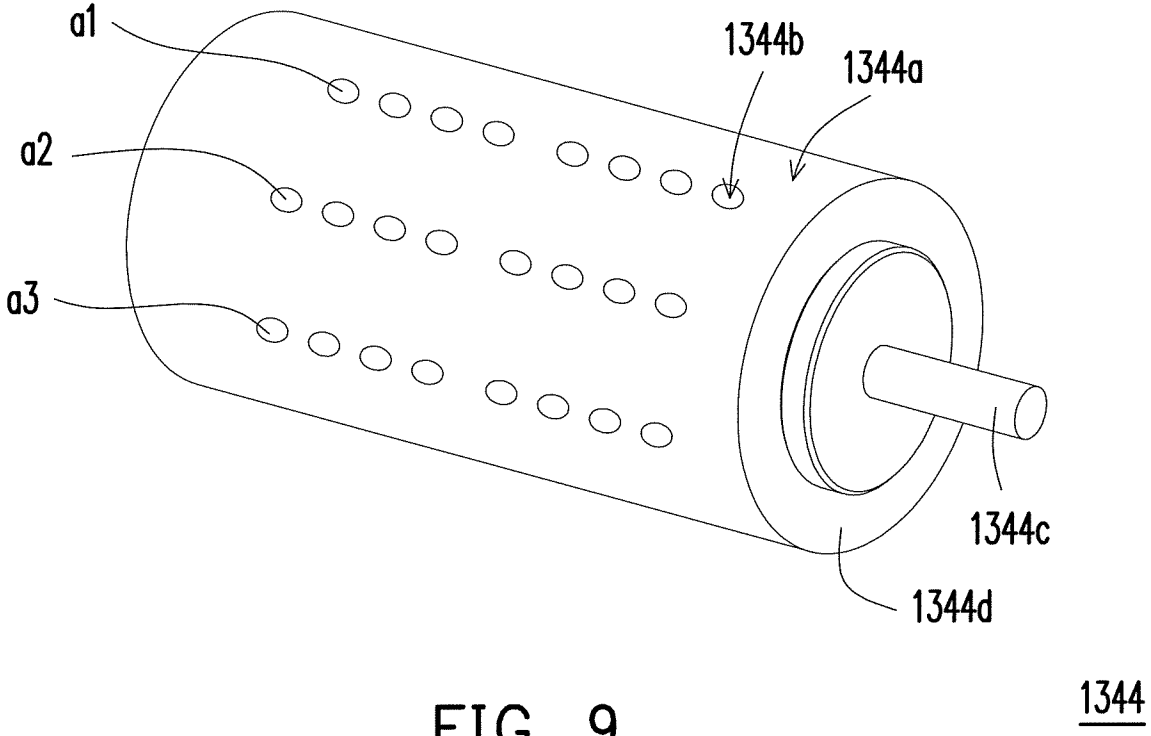
FIG. 9 is a schematic view of the rotating element of the first embodiment of the present invention.
Figure 10:
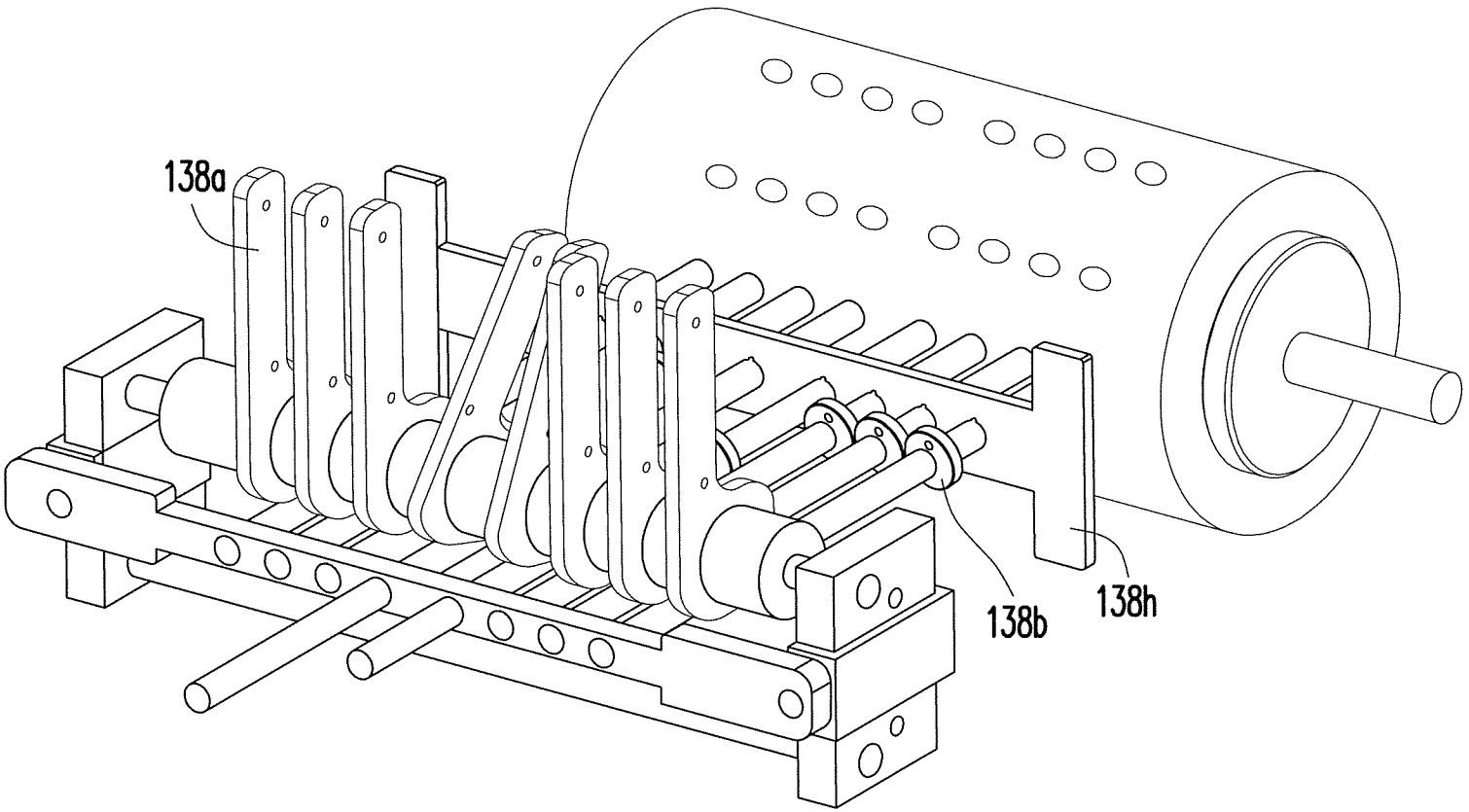
FIG. 10 and FIG. 11 are schematic views illustrating different control bars are pulled and rotate when limiting rings prop against different rows of the facial expression control structures.
Figure 11:
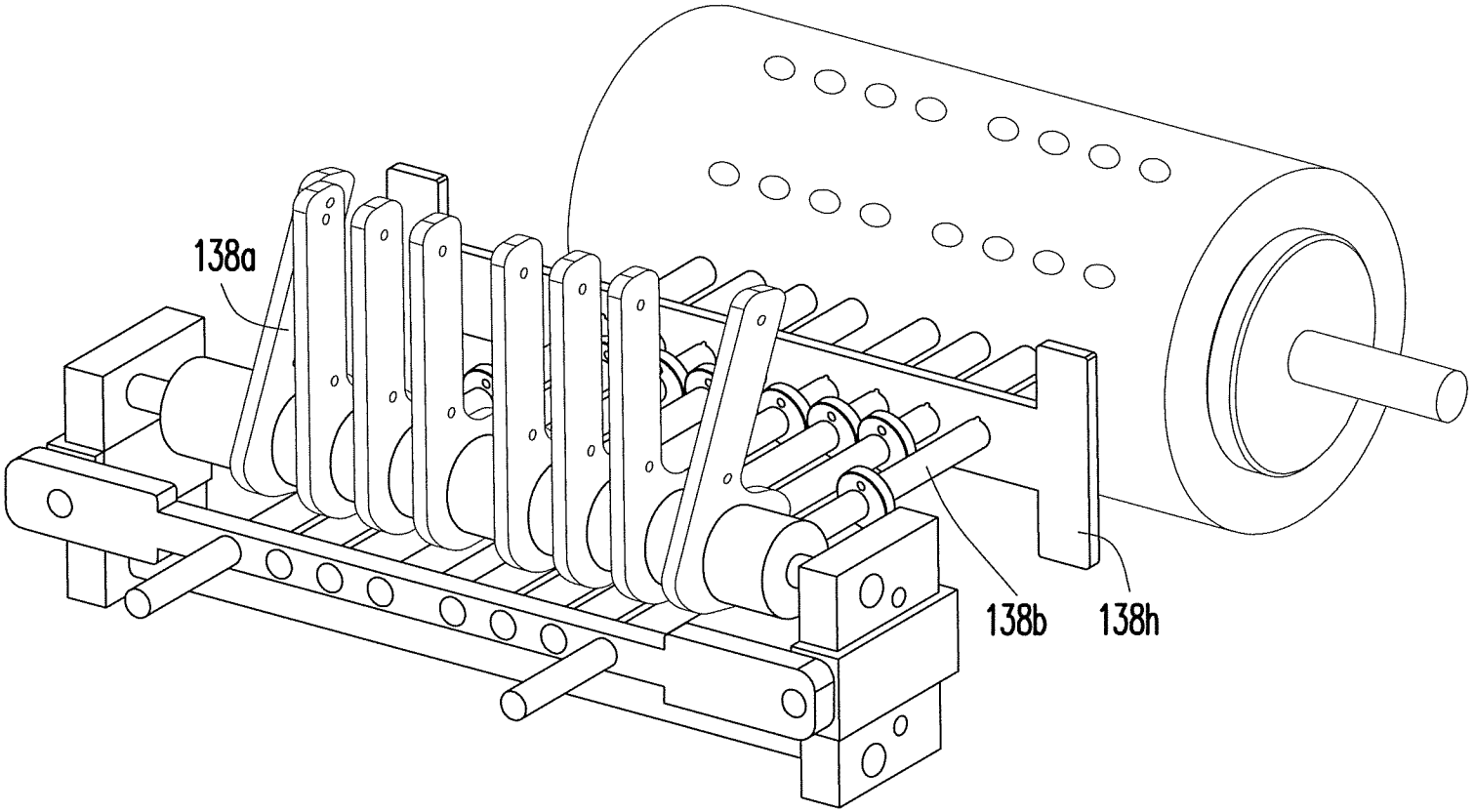

FIG. 9 is a schematic view of the rotating element of the first embodiment of the present invention. FIG. 10 and FIG. 11 are schematic views illustrating different control bars are pulled and rotate when limiting rings prop against different rows of the facial expression control structures. Referring to FIG. 9, the facial expression control structures 1344*b* on different rows result in different expression shown by the facial skin (not shown). For example, the pushing bars 1346 shown in FIG. 7 and FIG. 8 are respectively inserted into the row of facial expression control structures 1344*b* labeled as a1 shown in FIG. 9, and this results in that the robot head shows a facial expression. However, when the pushing bars 1346 are respectively inserted into the row labeled as a2 or a3 or other row of the facial expression control structures 1344*b*, the control bars 138*a* are pulled and thus the robot head shows another expression according to the row of the facial expression control structures 1344*b* which the pushing bars 1346 inserted therein, the facial expressions are illustrated as shown in FIG. 10 or FIG. 11.

As described above, in the facial expression control device 130 of this embodiment, only one actuator 1348 is necessary to drive the rotating element 1344 to rotate, and the pushing bars 1346 can further respectively prop against the facial expression control structures 1344*b* cooperated with the pushing assembly 136 pushing the facial expression control device 130 to drive the linking assembly 138 to pull the facial skin (not shown), wherein the number of control points to influence the facial expressions is determined according to the number of pushing bars 1346 and the number of facial expression control structures 1344*b* disposed on the rotating element 1344. Furthermore, the number of each row of facial expression control structures 1344*b* can be changed according to the requirements, and thus the number of the facial expression control structures 1344*b* can be increased to facilitate the facial skin (not shown) to show much more various expressions with good emulation.

Compared to the facial skin of the conventional robot head needs a large quantity of actuators to drive the control points, thus the manufacturing cost of the conventional robot head is rather expensive. Since less actuator is used in the robot head of the present invention to control the plurality of control points of the facial skin, the more facial expressions of the robot head with diversity and good emulation is achieved, and the manufacturing cost is also effectively reduced.

Second Embodiment

Figure 12:
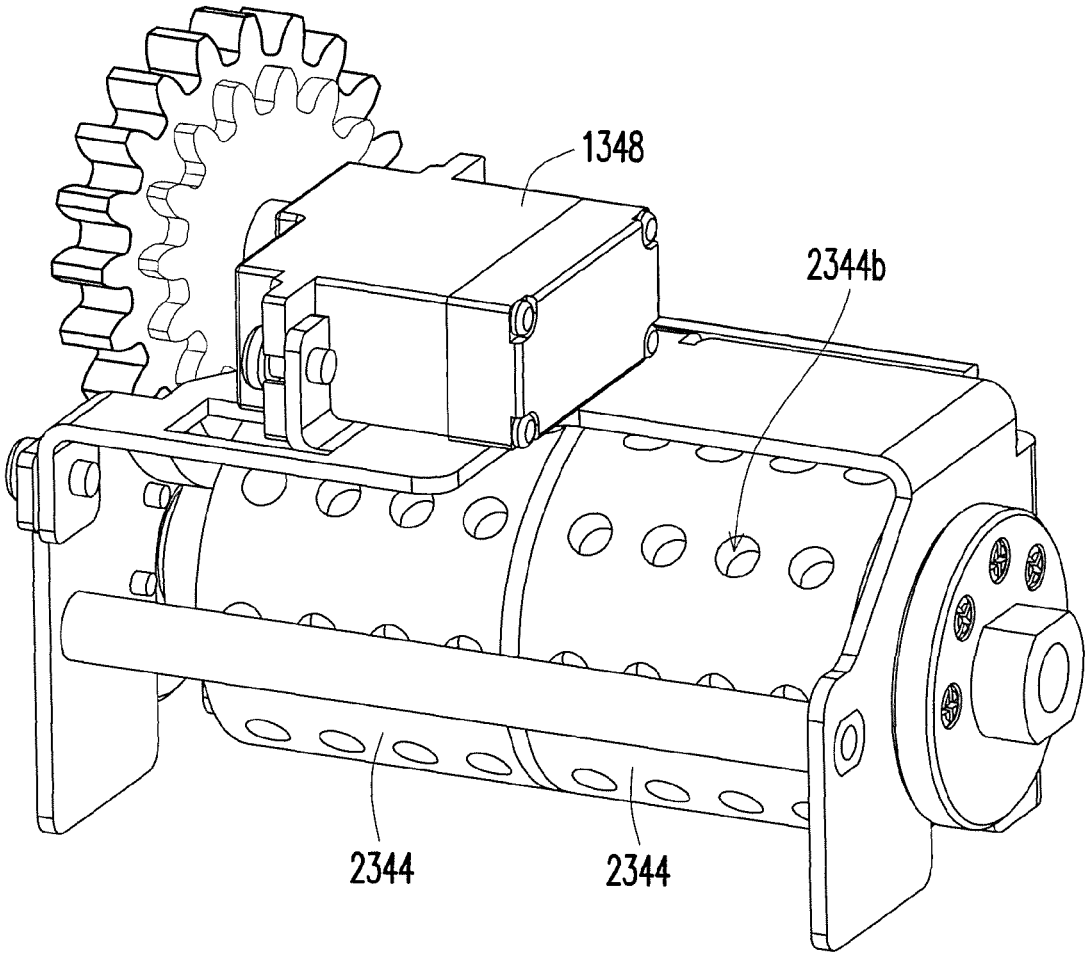
FIG. 12 is a schematic view of the frame, the rotating element and the actuator of the second embodiment of the present invention.

FIG. 12 is a schematic view of the frame, the rotating element and the actuator of the second embodiment of the present invention. Referring to FIG. 3 and FIG. 12, though only one actuator 1348 is used to directly control one rotating element 1344 in the above mentioned embodiment, in order to increase the diversity of the facial expressions, one rotating element 2344 separated into two parts are used in this embodiment and other mechanical driving methods, for example, linkage, gear or combination thereof are used, so that one actuator 1348 can simultaneously drive the two rotating elements 2344, and the rotating directions of the two parts of the rotating element 2344 may be the same or opposite, and at the same time the rotating angles of the two parts of the rotating element 2344 can be the same or different. In this way, the facial expression control structures 2344*b* of the rotating elements 2344 can have much more combinations, and thus the robot head can have much more expression variations.

Third Embodiment

Figure 13:
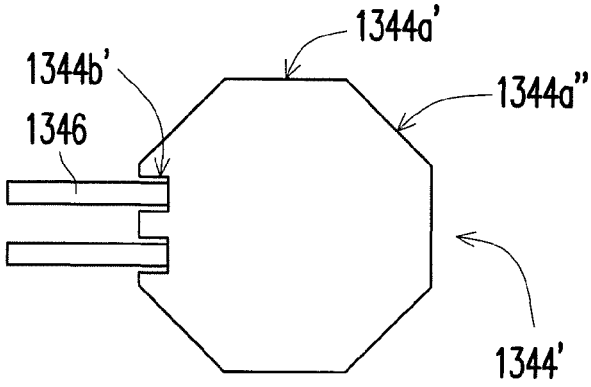
FIG. 13 is a schematic view of the third embodiment of the present invention.

In addition, though one row of the pushing bars and one row of the facial expression control structures are used in the description of the first embodiment, by this teaching people who have ordinary skill in the art may derive to other modifications according to the actual requirements. For instance, more rows of the pushing bars 1346 and more rows of the facial expression control structures 1344*b* can be disposed. FIG. 13 is a schematic view of the third embodiment of the present invention. Referring to FIG. 13, the rotating element 1344' is a polyhedral prism. In FIG. 13, the included angle formed between any two adjacent edges 1344*a*' and 1344*a*" of the cross-sectional of the polyhedral prism are the same, and two rows of the facial expression structures 1344*b*' can be disposed on each of the edges 1344*a*' (or 1344*a*"). And the two pushing bars 1346 are respectively inserted into the two rows of the facial expression control structures 1344*b*' of the rotating element 1344'. Correspondingly, the linking assembly 138 (shown in FIG. 3) and the pushing bars 1346 are respectively disposed, wherein the two linkage assemblies 138 are disposed with top and bottom being symmetric but the protruding directions of the control bars 138*a* (shown in FIG. 3) are opposite. Accordingly, by using only one rotating element 1344' the number of the control points of the facial skin (not shown) connected thereto is increased.

In such configuration, the quantity of combinations of expression variations can be increased and thus the robot head can show much more expressions with diversity and a good emulation.

Additionally, wires are used in the connecting structure between the pushing bars and the control bars described in the first, second and third embodiments, but the connection between the pushing bars and the control bars can be modified in other embodiments within the spirit of driving the pushing bars and the control bars of the present invention. The following describes another three of the possible embodiments.

Fourth Embodiment

Figure 14:
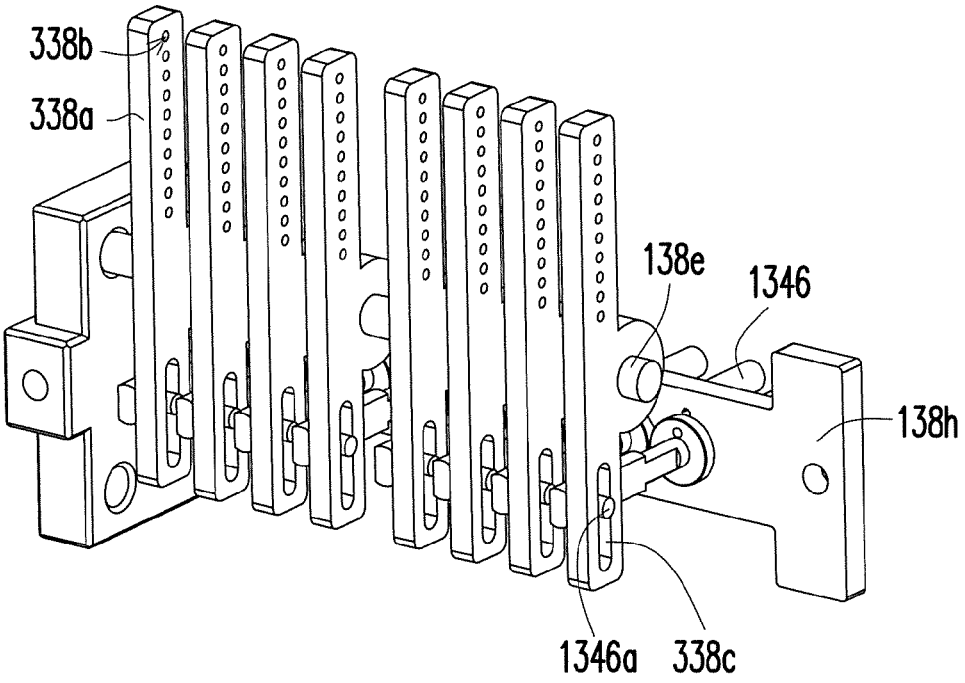
FIG. 14 is a schematic view illustrating the connecting of pushing bars and control bars of the fourth embodiment of the present invention.

FIG. 14 is a schematic view illustrating the connecting of pushing bars and control bars of the fourth embodiment of the present invention. Referring to FIG. 14, in this embodiment, each of the control bars 338*a* has a plurality of threading holes 338*b*, and the second wire 138*g* (shown in FIG. 6) can pass through one of the threading holes 338*b* disposed on one of the control bars 338*a* according to the requirements. The extent of the control point of the facial skin (not shown) is influenced by which one of the threading hole 338*b* is passed through by the second wire 138*g*, so that the expression shown by facial skin (not shown) may vary imperceptibly according to the extent of the control point being pushed or pulled. In addition, the pushing bars and the pushing bars are connected by latching. More specifically, an end of each of the control bars 338*a* relatively near to the pushing bars 1346 has a first latching structure 338*c*, and an end of each of the pushing bars 1346 relatively near to the control bars 338*a* has a second latching structure 1346*a*, wherein the first latching structure 338*c* is a latching slot and the second latching structure 1346*a* is a latching shaft, so as to latch the first latching structure 338*c* and the second latching structure 1346*a* together.

In this way, when the pushing bars 1346 move relative to the second assembling plate 138*h*, through the cooperation of the first latching structure 338*c* and the second latching structure 1346*a*, the control bars 338*a* may rotate by taking the rotating shaft 138*e* as a rotating center and further drive the facial skin (not shown) to show expressions.

Fifth Embodiment

Figure 15:
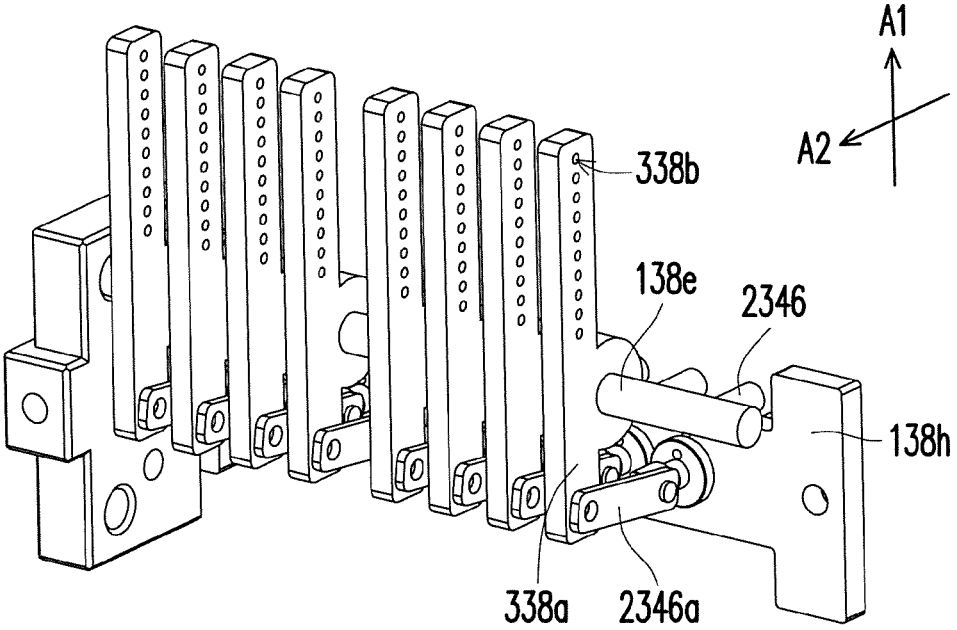
FIG. 15 is a schematic view illustrating the connecting of pushing bars and control bars of the fifth embodiment of the present invention.

FIG. 15 is a schematic view illustrating the connecting of pushing bars and control bars of the fifth embodiment of the present invention. Referring to FIG. 15, the difference between this embodiment and the fourth embodiment is that: the control bars and the pushing bars are connected by linkages. More specifically, an end of each of the pushing bars 2346 relatively near to the control bars 338*a* is a linkage 2346*a*. When the pushing bars 1346 approach to the control bars 338*a* along with the axial direction A2, the linkage 2346*a* connected with the control bars 338*a* may drive the control bars 338*a* to rotate by taking the rotating shaft 138*e* as a rotating center.

Sixth Embodiment

Figure 16:
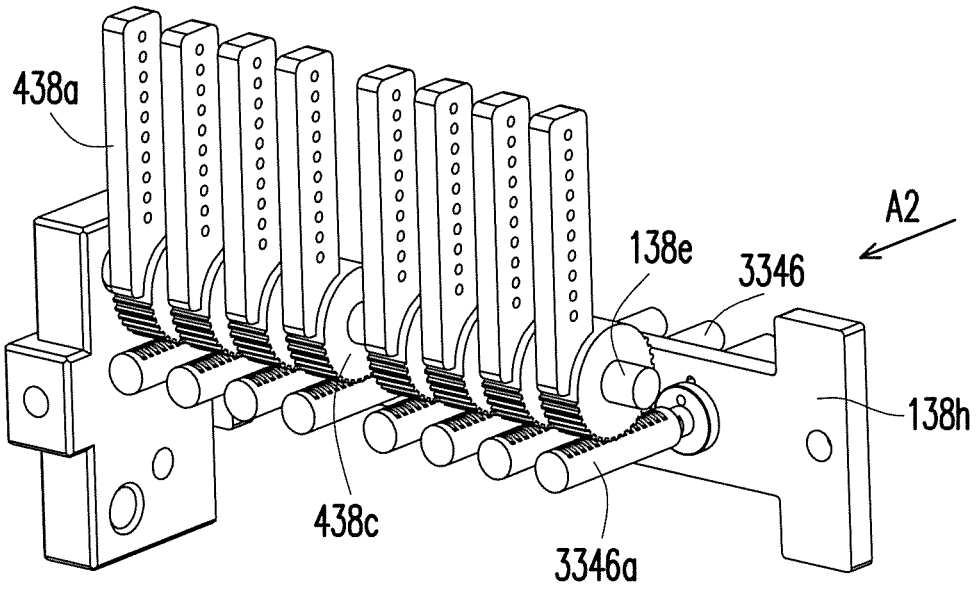
FIG. 16 is a schematic view illustrating the connecting of pushing bars and control bars of the sixth embodiment of the present invention.

FIG. 16 is a schematic view illustrating the connecting of pushing bars and control bars of the sixth embodiment of the present invention. Referring to FIG. 16, the difference between this embodiment and the fourth and fifth embodiment is that: the control bars and the pushing bars are connected by gears and racks. More specifically, an end of each of the control bars 438*a* relatively near to the pushing bars 3346 is a gear 438*c*, and an end of each of the pushing bars 3346 relatively near to the control bars 438*a* is a rack 3346*a*, and the gear 438*c* and the rack 3346*a* are engaged to each other. When the pushing bars 3346 move relative to the control bars 438*a* along the axial direction A2, the cooperation of the rack 3346*a* and the gear 438*c* makes the control bars 438*a* to rotate by taking the rotating shaft 138*e* as a rotating center. By using the configuration of gear 438*c* and rack 3346*a*, the rotating angle of the control bars 438*a* can be precisely controlled.

In light of the foregoing, in the facial expression control device and robot head using the same of the present invention, only one actuator is used to drive the rotating element to rotate, with the cooperation of heights or depths formed by the pushing bars respectively propping against the facial expression control structures, and by means of the cooperation of the pushing assembly pushing the facial expression control device for driving the linking assembly to drive the facial skin, the robot head further shows varied facial expressions. Compared to the conventional robot head, since the control points controlled by less actuator with the robot head shows a plenty of facial expressions with good emulation, and thus the number of actuators is reduced compared to the conventional robot and the manufacturing cost of the robot head is also effectively reduced. And the robot heads can further be produced with modulization so that the whole fabricating cost of the robot head can be reduced and it facilitates the popularity of the robot.

Furthermore, the quantity of each row of facial expression control structures can be changed according to the requirements, and the configuration of the facial expression control structures and the pushing bars and the connecting between the pushing bars and the control bars can also be changed according to the requirements, and thus the facial expressions are sufficient with good emulation and the facial skin having more expression variations without changing the quantity of actuators, and the design of the facial expressions is further flexible.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A facial expression control device, comprising:

a frame;

a rotating element, pivoted to the frame and located therein, having a surface and a plurality of facial expression control structures, wherein each one of the facial expression control structures arranged in rows is disposed on the surface and has a shifting distance relative to the surface;

a plurality of pushing bars arranged in at least one row and adapted to respectively prop against the facial expression control structures;

an actuator connected to the rotating element so as to drive the rotating element to rotate; and a linking assembly disposed on an extending direction of the pushing bars, wherein the pushing bars are located between the rotating element and the linking assembly, thereby a movement of the pushing bars respectively propped against the facial expression control structures are linked to a plurality of facial expression control points and generate a corresponding facial expression, wherein the linking assembly comprises:

a first assembling plate assembled onto the frame, wherein the pushing bars are inserted through the first assembling plate;

a plurality of control bars driven by the pushing bars; and a rotating shaft penetrating through the control bars such that the control bars are adapted to pivot upon the rotating shaft as the control bars driven by the pushing bars;

wherein the control bars has an axial direction, and an included angle is formed between the axial direction of the control bars and the axial direction of the pushing bars, thereby a rotating angle of the control bars relatively alters in accordance with the shifting distances of the facial expression control structures as the pushing bars respectively prop against the corresponding row of the facial expression control structures.

2. The facial expression control device as claimed in claim 1, wherein the rotating element comprises:

a rotating shaft;

a sleeve disposed around and fixed to the rotating shaft; and a transmission element disposed around the shaft and located beside the sleeve, wherein the transmission element contacts with the actuator and is rotated by the actuator thereby drives the rotating shaft and the sleeve to rotate as the actuator operates.

3. The facial expression control device as claimed in claim 1, wherein numbers of the facial expression control structures of each row are the same, and the number of the pushing bars is less than or equal to the number of the facial expression control structures of each row.

4. The facial expression control device as claimed in claim 1, wherein the shifting distances or extending directions of any two adjacent facial expression control structures are different.

5. The facial expression control device as claimed in claim 1, wherein the facial expression control structure is a protrusion or an indentation.

6. The facial expression control device as claimed in claim 1, wherein the linking assembly further comprises:

a plurality of limiting rings respectively disposed around the pushing bars; and a plurality of springs respectively disposed around the pushing bars and located at an end of the corresponding pushing bar away from the rotating element.

7. The facial expression control device as claimed in claim 1, further comprising a plurality of connecting structures, wherein the control bars are linked to the pushing bars through the connecting structures.

8. The facial expression control device as claimed in claim 7, wherein the connecting structures are selected from the group consist of wiring structures, linkage structures, latching structures or gear and rack structures.

9. The facial expression control device as claimed in claim 1, wherein the linking assembly further comprises a second assembling plate assembled onto the frame through which the pushing bars inserts, and the rotating shaft is located between the first assembling plate and the second assembling plate.

10. The facial expression control device as claimed in claim 1, further comprising a main base to assemble the facial expression control device to a robot head.

11. The facial expression control device as claimed in claim 10, further comprising a pushing assembly disposed on the main base, wherein the pushing assembly is connected to the facial expression control device such that the facial expression control device is capable to move relative to the main base along the extending direction of the pushing bars as the facial expression control device is pushed by the pushing assembly.

* * * * *